US007793909B2

(12) United States Patent
Sawyer

(10) Patent No.: US 7,793,909 B2
(45) Date of Patent: Sep. 14, 2010

(54) CANVAS BRIDGE

(75) Inventor: Stephen Shelby Sawyer, 143 Lexington St., Versailles, KY (US) 40383

(73) Assignee: Stephen Shelby Sawyer, Versailles, KY (US)

( * ) Notice: Subject to any disclaimer, the term of this patent is extended or adjusted under 35 U.S.C. 154(b) by 253 days.

(21) Appl. No.: 11/746,545

(22) Filed: May 9, 2007

(65) Prior Publication Data

US 2008/0277078 A1 Nov. 13, 2008

(51) Int. Cl.
*A47B 97/04* (2006.01)

(52) U.S. Cl. ..... 248/441.1; 248/451

(58) Field of Classification Search ..... 248/441.1, 248/451, 452, 229.12, 229.14, 229.22, 295.11, 248/297.21, 453; 38/102.1; 160/371
See application file for complete search history.

(56) References Cited

U.S. PATENT DOCUMENTS 3,738,606 A * 6/1973 Millen ..... 248/449
5,725,192 A * 3/1998 Cloninger ..... 248/458
5,899,429 A * 5/1999 McCloud ..... 248/441.1
2005/0230592 A1* 10/2005 Tillinghast et al. ..... 248/441.1

FOREIGN PATENT DOCUMENTS

FR 2679427 * 7/1991

* cited by examiner

*Primary Examiner*—Blair M. Johnson

(57) ABSTRACT

The canvas bridge is an easel accessory made of any material which is sturdy, durable and still retains some flexibility. It can be made of materials with a wide variety of properties. The design fits all easels. It is a long rectangular piece of material with a variety of lengths. Each end is elongated on the bottom side, creating the visual image of a bridge, from which a sharpened metal nail, or nail-like material extending approximately ¼ inch which is pushed into the canvas stretcher bars (stretcher bars are the wooden frame upon which the canvas is stretched).

2 Claims, 2 Drawing Sheets

FIGURE TWO
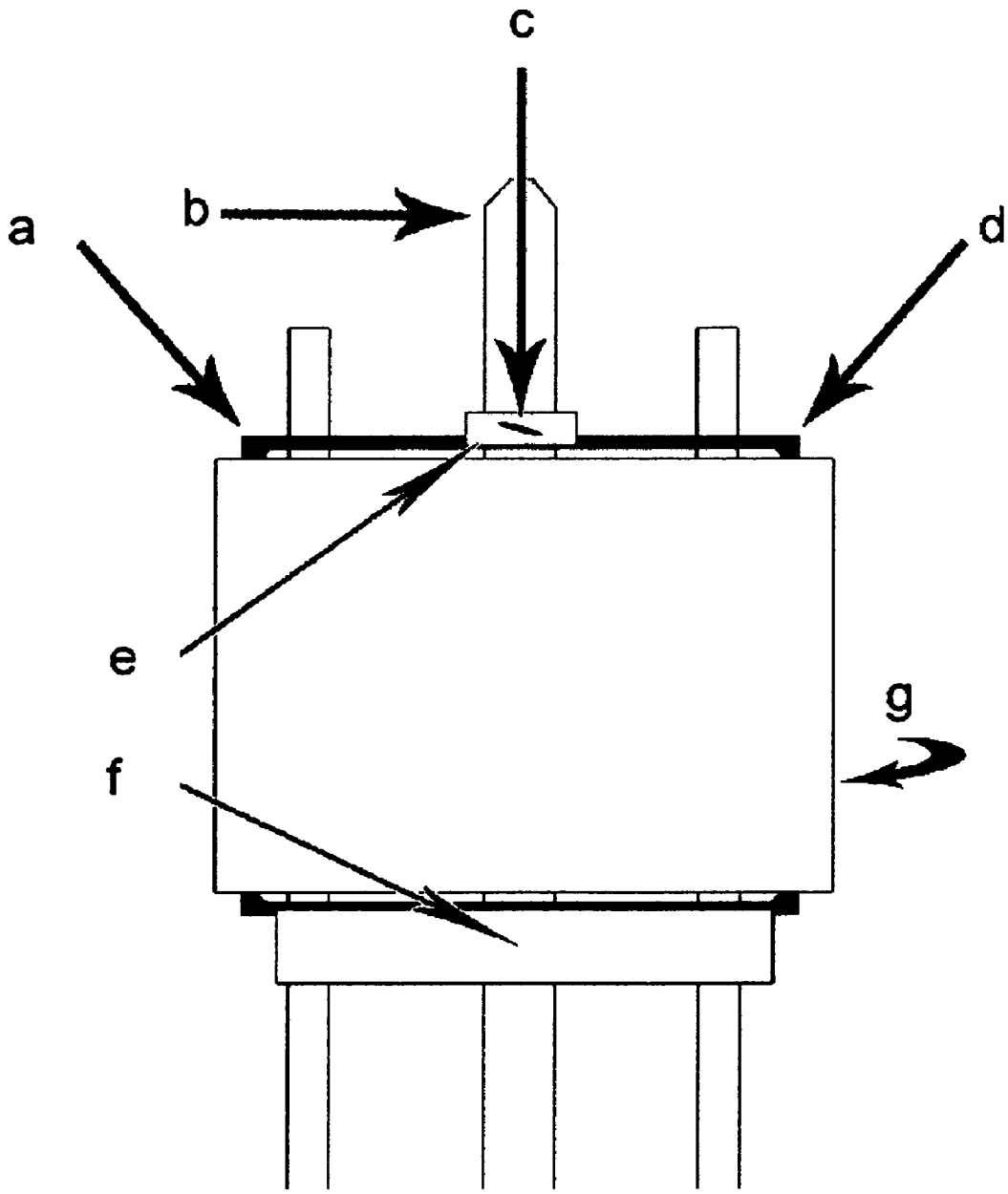

CANVAS BRIDGE

TECHNICAL FIELD AND BACKGROUND OF THE INVENTION

This invention addresses problems which artists will always experience when they attempt to fully secure their canvas upon an easel. Additionally this invention solves the problem that easels pose when the upper and lower lips of the canvas trays, which hold the canvas in place, also cover a portion of the paintable area of the canvas. The term "canvas" here specifically refers to a typical rectangular wooden frame with a fabric stretched tight over that frame.

A conventional easel has the singularly important function of holding a canvas in place. This invention serves the type of easel which has a securing mechanism as opposed to a tripod style display easel. Regardless of how the easel is adjusted, pivoted or rotated, the artist's easel always requires that the canvas is secured from the center top with pressure applied downward on a simple tray-like apparatus that typically slides up and down the center beam of the easel and is tightened with a thumb screw. This style of easel has been employed for several centuries. Inherent in the solution an easel provides is the problem that the canvas bridge solves.

A canvas cannot be fully secured and free of movement without apply so much downward force that the upper horizontal wooden stretcher bar is forced to flex under the downward securing pressure. This pressure will loosen the fabric supported by the stretcher bars of the canvas.

While the upper tray of most easels covers the paintable area of the canvas ½" for approximately 6 inches, the lower trays can cover ½" of the paintable surface as much as 24". Without a canvas bridge the artist must loosen, slide, and re-secure the canvas to the left or right of the trays to paint the previously covered portions of the upper canvas while the bottom tray makes it virtually impossible to fully access an uncovered area. Without the canvas bridge the artist risks scraping the painting against the tray lips which are designed to stop the canvas from falling off the easel. Structurally, the canvas bridge takes full advantage of the trays upper and lower lips as an extension of the actual canvas. Even if an easel does not have a lip for the upper and lower trays the canvas is still flush against the trays. This flush contact severely limits the type of brush stroke possible as the artist must always apply paint by touching the tray. The canvas bridge allows enough space, at the to and bottom of the secured canvas, to apply paint with brush strokes that are consistent with the rest of the painting. Therefore the canvas bridge has eliminated the difficult area to paint with the space it creates.

SUMMARY OF THE INVENTION

The advantages of this problem solving invention is that it can transform any easel into a piece of artist equipment which securely holds a canvas without applying unnecessary pressure to the upper stretcher bar and sagging the canvas cloth as well as allowing full coverage of the canvas which easels do not satisfactorily allow.

BRIEF DESCRIPTION OF THE DRAWINGS

Figure One: a side view of the canvas bridge

Figure Two: the canvas bridge in use above and below the canvas

DETAILED DESCRIPTION OF THE DRAWINGS

Figure One

Figure 1:
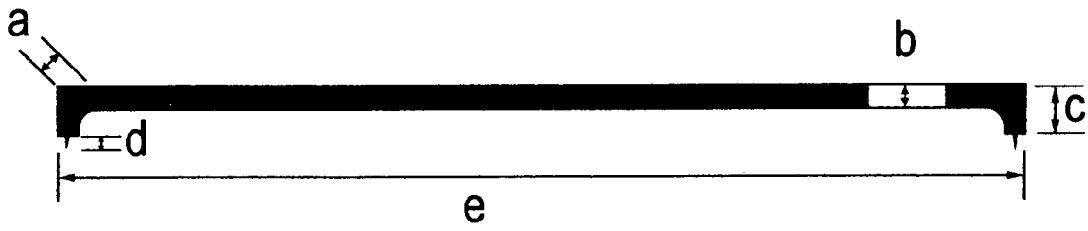

FIG. 1 shows the canvas bridge as it would be oriented when used at the top of an artists' canvas frame. a represents the width of the canvas bridge, b represents the thickness, c represents the height, d represents the length of the pointed element or nail and e represents the length. In the embodiment shown, a is ½ inch, b is ¾ inch, c is 1 inch, d is ¼ inch and e is 24 inches. It should be noted that other dimensions are possible depending on frames sizes, etc. The canvas bridge has an elongate body having at both ends a protrusion, represented by the height, c, each of which having a sharp, pointed element, such as a nail, represented by d.

Figure Two

FIG. 2: shows two canvas bridges. One on the top and one on the bottom of a canvas on an easel.

a is the left extended downward portion of the canvas bridge.

b represents the upright members of a typical easel.

c is the thumb screw on the sliding upper tray which, when tightened, holds a canvas in place.

d is the right extended downward portion of the canvas bridge.

e is the upper moveable tray of the easel used to secure the canvas which is always in the center of the easel.

f is the lower moveable tray of the easel used to secure the canvas.

g represents a typical canvas.

As clearly shown in FIG. 2, and in conjunction with FIG. 1, canvas bridges are provided at the top and at the bottom of the framed canvas. The bridges are disposed between respective upper and lower trays and the canvas frame. The nails penetrate the canvas frame and the upper tray is adjusted to provide a force, i.e., clamping force, between the canvas bridges which transfers the force to the edges of the canvas frame. The canvas bridges also serve to space the upper and lower edges of the frame from the respective trays.

I claim as my invention:

1. An easel in combination with a canvas bridge for supporting a framed artists' canvas, comprising:

an easel comprising;

at least one upright member, the upright member having a substantially horizontal lower tray mounted thereon for supporting a lower edge of a framed canvas, an upper tray movably mounted on the upright member above the lower tray for adjustably engaging an upper edge of the framed canvas, the upper and lower trays each having a length and adapted to clamp the framed canvas therebetween;

a canvas bridge comprising;

a substantially rigid elongate body having protrusions on each respective end thereof, the protrusions extending generally orthogonally and in the same direction from the elongate member, each protrusion having a sharp pointed member extending from an end thereof, the body having a length greater than the length of the upper tray;

wherein, the canvas bridge is separate and unconnected to the easel and is adapted to be removably disposed between the upper tray and the upper edge of the framed canvas such that the pointed members are capable of penetrating and thus securely engaging the upper edge when the framed canvas is supported between the upper and lower trays, the canvas bridge spacing the upper edge of the framed canvas from the upper tray and the clamping force applied by the upper tray to the framed canvas can be distributed beyond the upper tray to the ends of the upper edge of the framed canvas.

2. The combination of an easel and a canvas bridge of claim 1 above, further comprising:

a second canvas bridge adapted to be removably located between the lower tray and the lower edge of the framed canvas, the second canvas bridge spacing the lower edge of the framed canvas from the lower tray when the framed canvas is supported between the upper and lower trays and also capable of distributing the clamping force from the lower tray to the ends of the lower edge of the framed canvas.

* * * * *